US005967122A

United States Patent [19]

Muntzer et al.

[11] Patent Number: 5,967,122

[45] **Date of Patent: *Oct. 19, 1999**

[54] COMPUTER-CONTROLLED INTERNAL COMBUSTION ENGINE EQUIPPED WITH SPARK PLUGS

[75] Inventors: Henry P. Muntzer, Port Angeles; Everett P. Lamprecht, Sequim, both of Wash.; Erhan Kunt, Dededo, Guam

[73] Assignee: Bisnes Mauleg, Inc., Dededo, Guam

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,067

[22] Filed: Jun. 17, 1997

Related U.S. Application Data

[63] Continuation-in-part of application No. 08/665,517, Jun. 17, 1996, abandoned, and a continuation-in-part of application No. 08/677,508, Jul. 9, 1996, Pat. No. 5,767,613.

[51] Int. Cl.[6] ..... F02D 41/30; H01T 13/20

[52] U.S. Cl. ..... 123/486; 123/169 EL; 313/139; 313/141

[58] Field of Search ..... 123/143 B, 169 EL, 123/598, 620, 486; 313/138, 139, 141, 142

[56] References Cited

U.S. PATENT DOCUMENTS

| | | | |
|---|---|---|---|
| 1,368,358 | 2/1921 | Schwetger | 123/169 EL |
| 1,962,669 | 6/1934 | Parkin, Jr. | 313/138 X |
| 1,989,670 | 2/1935 | Anthony | 313/139 |
| 2,080,110 | 5/1937 | Brenner | 75/172 |
| 2,251,179 | 7/1941 | Weinerth | 313/139 X |
| 2,795,723 | 6/1957 | Townsend, Sr. | 313/141 |
| 3,133,223 | 5/1964 | Mallory | 313/141 X |
| 3,187,733 | 6/1965 | Heintz | 123/447 |
| 3,538,372 | 11/1970 | Terao | 313/141 X |
| 3,706,897 | 12/1972 | Shepardson | 313/141 |
| 3,719,851 | 3/1973 | Burley | 313/123 |
| 3,926,169 | 12/1975 | Leshner | 123/297 |
| 3,974,412 | 8/1976 | Pratt, Jr. | 313/131 R |
| 4,015,160 | 3/1977 | Lara et al. | 313/139 |
| 4,109,633 | 8/1978 | Mitsudo et al. | 123/169 EL |
| 4,161,937 | 7/1979 | Gerry | 123/169 EL |
| 4,183,334 | 1/1980 | Van Dine | 123/510 |
| 4,186,707 | 2/1980 | Driggers | 123/512 |
| 4,218,880 | 8/1980 | Kuroda et al. | 60/278 |
| 4,365,186 | 12/1982 | Gerry | 315/209 R |
| 4,406,254 | 9/1983 | Harris et al. | 123/1 A |
| 4,442,375 | 4/1984 | Nishio et al. | 313/142 |
| 4,677,960 | 7/1987 | Ward | 123/598 |
| 4,695,758 | 9/1987 | Nishida et al. | 313/130 |
| 4,743,793 | 5/1988 | Toya et al. | 313/141 |

(List continued on next page.)

*Primary Examiner*—Tony M. Argenbright
*Attorney, Agent, or Firm*—Chadbourne & Parke LLP

[57] ABSTRACT

An internal combustion engine that burns fuel from a fuel source, and an engine including a block assembly with a piston cylinder, a combustion chamber connected to the piston cylinder, and an air/fuel mixing area that communicates with the combustion chamber for delivering an air/fuel mixture to the combustion chamber. A fuel delivery system is connected to the block assembly, and the fuel delivery system is adapted to deliver a selected amount of fuel into the mixing area for mixing with air therein to provide an air/fuel mixture having an air-to-fuel ratio in the range of approximately 20:1 to 45:1, inclusive. A spark plug is connected to the block assembly and positioned to generate a spark in the combustion chamber to detonate the air/fuel mixture. The spark plug has a center electrode and a ground electrode axially spaced apart from each other by a spark gap in the range of approximately 1.8 mm to 3.0 mm. The center electrode of one embodiment is an Inconel 600 steel alloy electrode having a diameter in the range of 4.0 mm to 7.5 mm. In one embodiment, an electronic control module (ECM) is coupled to the engine to control operating parameters, and the ECM has a PROM that is programmed to control formation of the air/fuel mixture with the air-to-fuel ratio in the range of approximately 20:1 to 45: 1, inclusive.

22 Claims, 6 Drawing Sheets

U.S. PATENT DOCUMENTS

| | | | |
|---|---|---|---|
| 4,841,925 | 6/1989 | Ward | 123/598 X |
| 4,922,958 | 5/1990 | Lemp | 137/561 A |
| 4,955,409 | 9/1990 | Tokuda et al. | 137/561 A |
| 5,022,355 | 6/1991 | Billingsley et al. | 123/184.39 |
| 5,056,496 | 10/1991 | Morino et al. | 123/604 |
| 5,121,730 | 6/1992 | Ausman et al. | 123/467 |
| 5,156,134 | 10/1992 | Tochizawa | 123/541 |
| 5,168,856 | 12/1992 | Lorraine | 123/468 |
| 5,196,760 | 3/1993 | Takamura et al. | 313/142 |
| 5,200,900 | 4/1993 | Adrain et al. | 123/486 X |
| 5,211,147 | 5/1993 | Ward | 123/661 X |
| 5,295,467 | 3/1994 | Hafner | 123/456 |
| 5,493,171 | 2/1996 | Wood, III et al. | 313/141 |

COMPUTER-CONTROLLED INTERNAL COMBUSTION ENGINE EQUIPPED WITH SPARK PLUGS

CROSS-REFERENCE TO RELATED APPLICATIONS

This is a continuation-in-part of U.S. application Ser. No. 08/665,517, filed Jun. 17, 1996, now abandoned. This is also a continuation-in-part of U.S. application Ser. No. 08/677,508, filed Jul. 9, 1996, now U.S. Pat. No. 5,767,613.

TECHNICAL FIELD

The invention relates to internal combustion engines and devices used in and with the internal combustion engines for efficient combustion of fuel to provide improved power, fuel efficiency and substantially reduced emissions.

BACKGROUND OF THE INVENTION

In a conventional gasoline powered internal combustion engine, gasoline is channeled through a fuel injector or carburetor, and then mixed with air to provide an air-to-fuel ratio of approximately 10:1 to 14:7:1. The gasoline and air mixture is then delivered into a combustion chamber and ignited by a spark generated by a spark plug. The conventional engine configuration is such that a substantial amount of gasoline is contained in the air/fuel mixture delivered into the combustion chamber, and the gasoline is not all consumed upon ignition by the spark plug's spark. As a result, the engine discharges exhaust containing unburned gasoline and other emissions, such as carbon monoxide, carbon dioxide, hydrocarbons, or nitrogen oxides ($NO_x$), into the environment.

In most vehicles built after the late 1980s, a conventional on-board computer, also known as an electronic control module or ECM, is mounted to the vehicle and connected to the engine. The ECM controls and monitors a wide range of engine conditions, including the fuel flow and fuel delivery to the engine. The ECM also controls the air/fuel mixture's air-to-fuel ratio during different driving conditions. For example, the air-to-fuel ratio for normal driving when the throttle is partially open is 14.7:1. When additional power is needed and the throttle is wide open, such as when pulling a load up a hill, the ECM adjusts the air-to-fuel ratio to 12:1, so more fuel is used to achieve the necessary power increase. The ECM monitors multiple sensors in the engine and adjusts various operating parameters to maintain the air-to-fuel ratio at a selected value. The ECM also controls the engine's timing for spark generation to detonate the air/fuel mixture when the engine's pistons are at selected positions within the cylinders so as to achieve the desired power from the engine.

The ECMs have one or more computer chips, such as PROMs (Programmable-Read-Only Memory) that contain instructions and calibration data for operation of the engine. The computer chips provided by the vehicle's manufacturer, however, are programmed with factory settings for engine operation with conventional spark plugs to achieve an acceptable engine performance that provides sufficient power with reasonable fuel efficiency and acceptable engine emissions.

The conventional ECM has a computer chip or PROM that can be removed and replaced with a custom chip programmed with different instructions and calibration data to change and improve aspects of the engine's performance, such as power output. Other ECMs have reprogrammable PROM (e.g., Flash EEPROM) that can be reprogrammed with the different instructions and calibration data. For example, a custom computer chip or reprogramming includes instructions and calibration data for the ECM to increase the engine's power out, which typically results in decreased fuel efficiently and often unacceptably high engine emissions. Accordingly, these custom computer chips are typically illegal for street vehicles (e.g., non-racing or non-off road vehicles) unless expensive federal test procedures and other requirements are met.

The engine controlled by the ECM uses conventional spark plugs for ignition of the air/fuel mixture. The conventional spark plug has a 1.3 mm to 2.0 mm diameter center electrode that is spaced apart from a similarly sized ground electrode by approximately a 0.8 mm gap. The spark plug is connected to the vehicle's coil and when the voltage at the center electrode reaches the ionization point, the electrical charges jump the gap in the form of a spark. The spark plugs are typically driven by a conventional 15,000–30,000 volt coil which provides the necessary spark voltage that allows the spark to arc across the gap.

The conventional spark plug design is such that the spark generated is a relatively small, blue spark. This small blue spark usually provides enough heat to detonate the air/fuel mixture in the combustion chamber so as to drive one of the engine's pistons on the down stroke. While the conventional spark plugs allow the engine to run at what consumers consider acceptable levels, the spark plugs do not necessarily optimize the engine's performance. The spark plugs have relatively small gaps that requires less voltage to generate the spark, which results in a cool or lower power spark. This lower power spark ignites the air/fuel mixture with lower efficiency than a hot spark, so more fuel is required in the air/fuel mixture to achieve the desired power output from the engine. Accordingly, the engine operates with a lower fuel efficiency. In addition, the spark plugs inefficient ignition also results in an incomplete burn of the fuel, thereby resulting in higher engine emissions.

Many modifications to spark plugs and other engine components have been tried in an attempt to obtain increased power without unacceptable decreases in fuel efficiency and increases in emissions. As an example, Splitfire of Illinois, U.S.A. manufactures a spark plug having a standard center electrode that is spaced apart by a standard spark gap from a V-shaped ground electrode, which provides two areas to which a spark can arc. One goal of Splitfire's spark plug is to allow a spark to arc to each leg of the ground electrode to produce more spark for igniting the air/fuel mixture.

BERU of Germany produces for Nology Engineering, a Silverstone™ spark plug having a 2 mm diameter, silver center electrode for highly efficient conduction of current from the ignition coil through the spark plug. The silver center electrode is spaced apart from a standard ground electrode by a standard spark gap of approximately 0.8 mm. The Silverstone™ spark plugs are combined, however, with a higher voltage, retrofit ignition coil that provides an increased available spark voltage so as to create a more powerful and hotter spark than the thin blue spark of the other conventional spark plugs. Although the Silverstone™ spark plug provides a powerful and hotter spark, the spark plug requires the use of the higher voltage coil to obtain the greater power output by the conventional engine. A further drawback to the Silverstone™ spark plug is that the silver center electrode is relatively soft and generation of the more powerful, hotter spark results in a shorter useful life than other conventional spark plugs.

The conventional spark plug's center electrode also has a relatively small surface area from which sparks extend across the gap. The small surface area, however, is subject to more localized heat from spark generation during the spark plug's life, because the sparks can only be generated from that small area. As a result, the conventional spark plug's center electrode is worn over time, thereby reducing the spark plug's useful life.

The conventional spark plug's lower power spark and smaller surface area at the center electrode also results in a greater number of misfires. When the spark plug misfires, a proper spark is either not provided or the spark does not ignite the air/fuel mixture for that cycle. Accordingly, a misfiring spark plug reduces the engine's fuel efficiency and power output and increases the engine's emissions.

The conventional spark plug also causes relatively high exhaust temperatures, which causes the engine to run hotter, thereby requiring cooling systems and the like for the engine. These higher temperatures are caused by the spark plug because the lower power spark provides less heat, so less of the air/fuel mixture is ignited simultaneously at the beginning of the air/fuel mixture's detonation. As a result, the flame from growth through the air/fuel mixture is slower, so more time is required to detonate the mixture in the combustion chamber. This longer detonation period results in more heat energy that is not converted to kinetic energy, so the combustion exhaust is hotter, which results in higher engine operating temperature. These higher engine operating temperatures require that the engine's components be made of materials that can withstand the higher operating temperatures, which typically increase the engine's cost and weight.

SUMMARY OF THE INVENTION

The present invention provides a combination of an engine control system and an electric discharge generating device in an internal combustion engine that overcomes drawbacks experienced by conventional internal combustion engines in trying to achieve increased power and fuel efficiency without increasing engine emissions. In one exemplary embodiment of the invention, an electronic control module is coupled to an internal combustion engine and programmed to control fuel flow to a combustion chamber to provide an air/fuel mixture having an air-to-fuel ratio in the range of approximately 20:1 to 45:1, inclusive. An electric discharge generating device is provided adjacent to the combustion chamber for detonation of the air/fuel mixture. The electric discharge generating device has an enlarged first electrode with a sparking surface having a surface area of approximately 12.56 $mm^2$ or greater. The sparking surface is spaced apart from a ground electrode by an enlarged electric discharge gap of approximately 1.8 mm or greater. The electric discharge generating device generates an enlarged, high power hot spark across the gap for faster fuel detonation, shorter flame front growth duration and substantially complete combustion of the air/fuel mixture, thereby increasing fuel efficiency and decreasing engine emissions without a power reduction. In addition, the combustion exhaust is cooler so the engine runs cooler.

In one embodiment, the electronic control module has a removable computer chip that is programmed to control the engine's fuel delivery system to maintain the air-to-fuel ratio at a selected value within the range of 20:1 to 45:1, inclusive. The spark plug has a center electrode having a diameter of approximately 4 mm or greater and the electric discharge gap of approximately a 1.8 mm or greater. The ground electrode has a spark grounding surface spaced axially apart from the center electrode's sparking surface, and the spark grounding surface has the same or larger surface area than the sparking surface's surface area. Accordingly, the center electrode's sparking surface, the ground electrode's spark grounding surface, and the gap define an enlarged detonation area having a volume of approximately 22.61 $mm^3$ or greater.

The present invention also provides a method of detonating an air/fuel mixture in a combustion chamber of an internal combustion engine. The method in one embodiment includes providing an air/fuel mixture to the combustion chamber, the mixture having an air-to-fuel ratio of approximately 20:1 or greater, generating one or more electric discharges across an electric discharge gap of approximately 1.8 mm or greater between a pair of axially spaced apart electrodes, one of which has a sparking surface of approximately 12.56 $mm^2$ or greater, and detonating the air/fuel mixture with the one or more electric discharges.

DETAILED DESCRIPTION OF THE INVENTION

Figure 1:
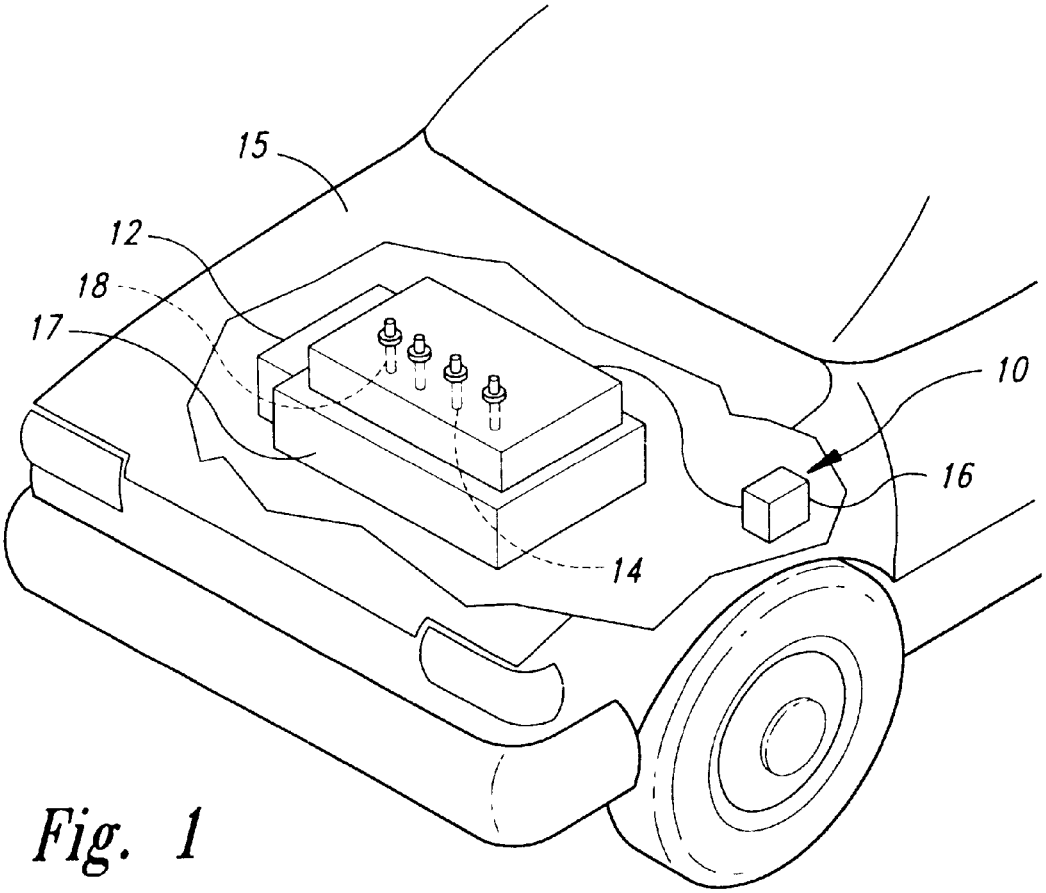
FIG. 1 is a schematic view of an internal combustion engine with a plurality of spark plugs shown in hidden lines and an electronic control module coupled to the engine in accordance with the present invention.

The embodiments of an engine control system and spark plug coupled to an internal combustion engine in accordance with the present invention are described below with reference to the appended drawings. As best seen in FIG. 1, an engine control system 10 of an internal combustion engine 12 is illustrated operatively connected to a fuel delivery system 14. The engine control system 10 includes an electronic control module (ECM) 16, also referred to as an "on-board computer," that is mounted to a vehicle 15 and operatively connected to the engine 12. The engine control system 10 controls and monitors operating parameters of the engine 12, including fuel flow through the fuel delivery system 14, and delivery of an air/fuel mixture with a selected air-to-fuel ratio to a combustion chamber 17 of the engine. The engine control system 10 also controls the timing of spark generation and air/fuel mixture detonation by spark plugs 18 that are mounted in the engine. The engine control system 10 and the spark plugs 18 are combined in this exemplary embodiment such that the engine 12 operates in a highly fuel efficient manner while providing increased power and reduced engine emissions as compared to a similarly sized engine without the engine control system and spark plugs of the present invention.

Figure 2:
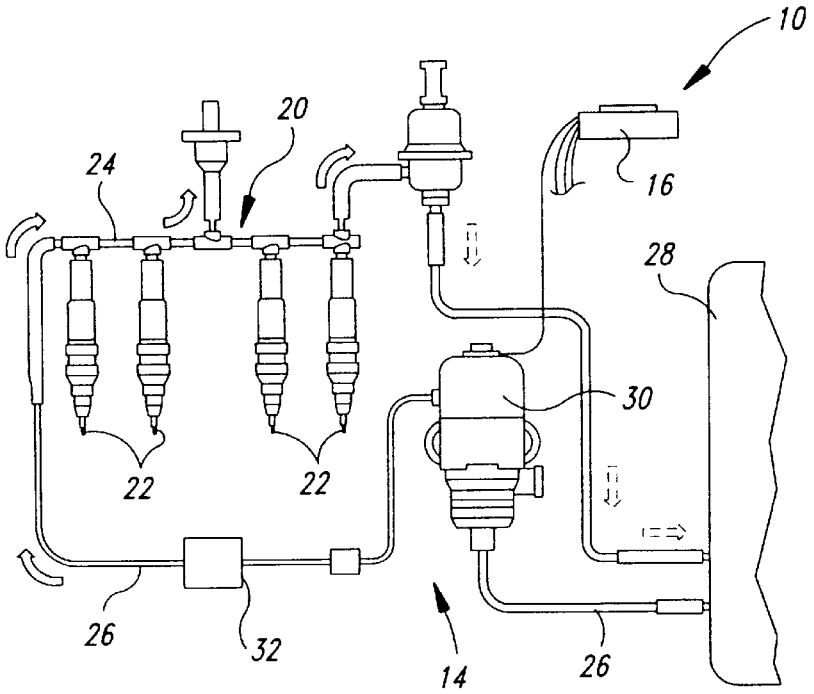
FIG. 2 is a schematic view of a fuel delivery system of the engine of FIG. 1.

As best seen in FIG. 2, the fuel delivery system 14 of the exemplary embodiment includes a fuel injection system 20 having a plurality of fuel injectors 22 connected to a fuel tube 24. The fuel tube 24 is operatively connected to a fuel line 26 that is, in turn, connected to a fuel tank 28, so the fuel line and fuel tube carry gasoline from the fuel tank to the fuel injectors 22. The fuel line 26 includes a fuel pump 30 that pumps the gasoline from the fuel tank 28 toward the fuel injectors 22. The fuel pump 30 is operatively connected to and controlled by the ECM 16, such that the ECM controls the rate that gasoline passes to and through the fuel injectors 22. A fuel filter 32 is connected to the fuel line 26 for filtering the gasoline as it flows through the fuel line to remove impurities before the gas reaches the fuel injectors 22 to avoid clogging the fuel injectors.

Figure 3:
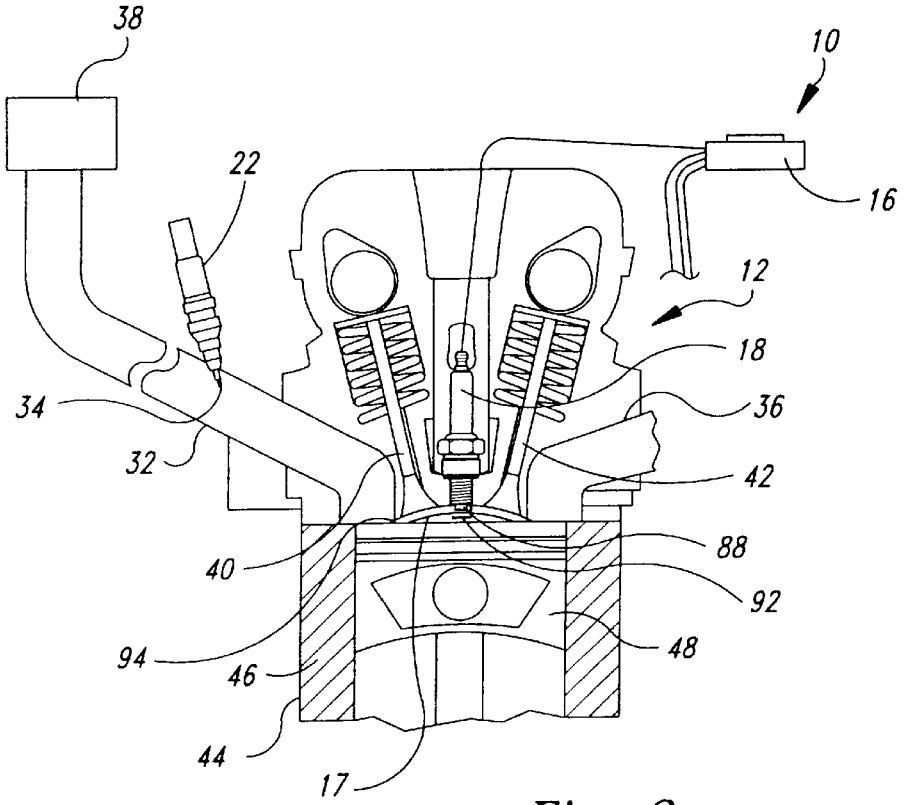
FIG. 3 is an enlarged schematic cross-sectional view of a fuel injector of the engine of FIG. 1 and an associated combustion chamber, with a spark plug shown adjacent to the combustion chamber.

As best seen in FIG. 3, each fuel injector 22 delivers the gasoline to an intake manifold 32 that provides a mixing area for mixing the gasoline and air, and the intake manifold communicates with one of the combustion chambers 17 of the engine 12. The fuel injector 22 has a conventional injector nozzle 34 that projects into the intake manifold 32. The injector nozzle 34 receives a portion of the gasoline from the fuel tube 24 and directs it into the intake manifold 32 to create a very finely atomized fuel. The finely atomized fuel is combined with air in the intake manifold 32, and the air/fuel mixture enters the combustion chamber 17 for detonation by the spark plug 18.

The engine 12 also includes an exhaust manifold 36, an air filter 38 coupled to the intake manifold 32, an intake valve 40, and an exhaust valve 42. The engine 12 also includes a conventional engine block assembly 44 with a piston cylinder 46 below the combustion chamber 17, and a piston 48 reciprocating within the cylinder. The spark plug 18 in accordance with the present invention is positioned at the top of the combustion chamber 17.

The injector nozzle 34 operating in accordance with the present invention sprays a selected amount of fuel into the intake manifold 32 for mixing with air in a selected air-to-fuel ratio to provide a very lean air/fuel mixture. The air/fuel mixture is passed into the combustion chamber 17 where it is compressed by the piston 48 during its up-stroke, and the air/fuel mixture is detonated by the spark plug 18 at a selected time relative to the piston's position in the cylinder 46. The spark plug 18 is operatively connected to the ECM 16, and the ECM controls the timing for generation of an electric discharge by the spark plug relative to the piston's position in the cylinder 46. The details of the improved spark plug 18 of the present invention are discussed below following discussion of the ECM 16.

Figure 4:
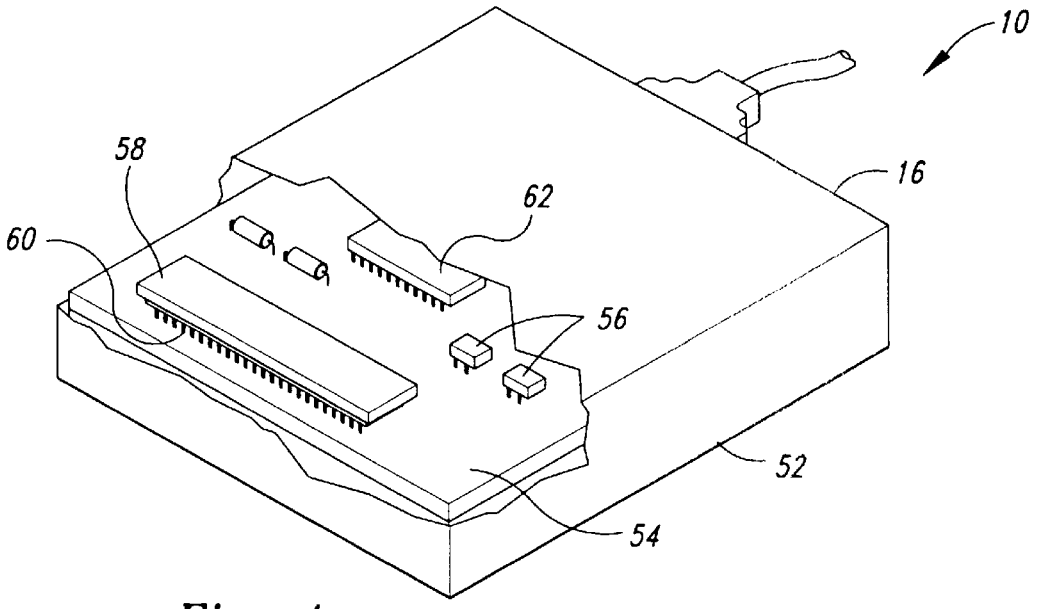
FIG. 4 is an enlarged partial fragmentary isometric view of the electronic control module of FIG. 1, a portion of the module's outer housing being shown broken away to show the computer chips therein.

As best seen in FIG. 4, the ECM 16 includes a protective outer housing 52 that contains a plurality of conventional computer components 56 mounted to a printed circuit board 54. A memory device in the form of a specially preprogrammed primary computer chip 58 or programmable read-only-memory (PROM) is connected by a plurality of connector pins extending from the printed circuit board 54. The computer chip 58 is programmed with a plurality of instructions, calibration data, and other engine operating parameters that correspond to the engine's configuration to achieve the desired balance of performance, fuel efficiency, and emission characteristics when operating as part of the engine control system 10 of the present invention.

The ECM 16 also includes a backup computer chip 62 that is programmed with conventional backup engine operating parameters that are used should the primary computer chip 58 fail. This backup computer chip 62 is referred to as a "limp home" chip that is adapted to allow the vehicle to be driven, as an example, to a service station or repair shop, although the engine operates at substantially less than peak performance.

Figure 5:
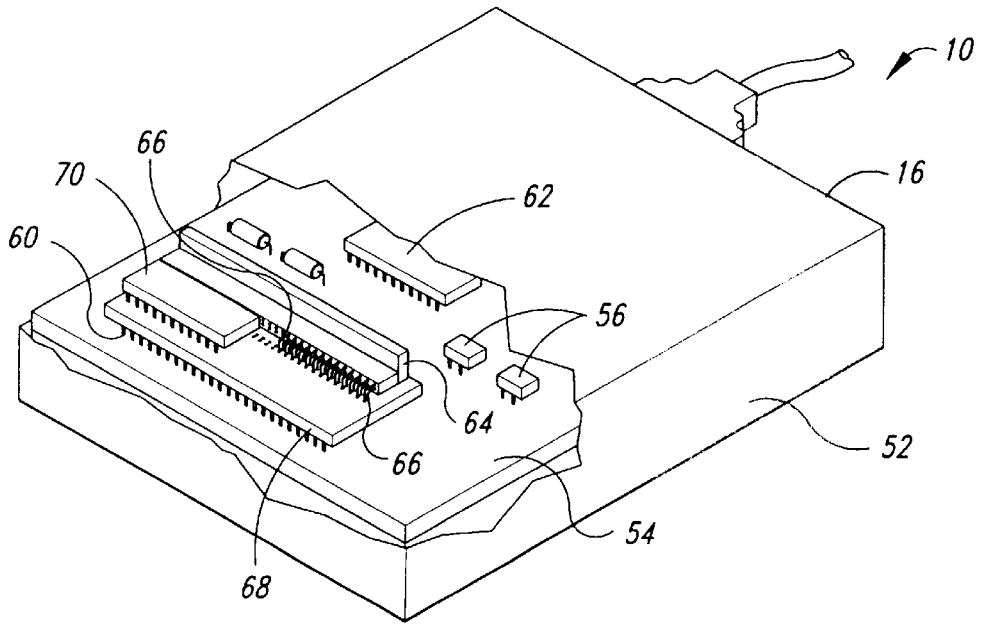
FIG. 5 is an enlarged partial fragmentary isometric view of an alternate embodiment of the electronic control module of FIG. 1, a portion of the module's outer housing being shown broken away to show the computer chips therein.

In an alternate embodiment, as best seen in FIG. 5, the ECM 16 has a conventional factory-programmed computer chip 64 for the vehicle 15 connected by a plurality of connector pins 66 that extend from a circuit board bridge 68. The bridge 68 removably plugs onto the connector pins 60 extending from the printed circuit board 54 to which the factory-programmed computer chip 64 would normally plug onto for a vehicle not equipped with the present invention. Accordingly, the factory-programmed computer chip 64 is still operatively connected to the ECM's printed circuit board 54 of the present invention via the bridge 68.

A supplemental computer chip 70 in accordance with the present invention is mounted to the bridge 68 and operatively connected to the ECM's printed circuit board 54 via the bridge. The supplemental computer chip 70 is programmed with selected instructions and calibration data including air-to-fuel ratios, fuel tables, spark timing tables, and system activation settings for the particular type of the vehicle 15. The supplemental computer chip 70 is programmed in a conventional manner to override the instructions and calibration data of the factory-programmed computer chip 64, so the ECM 16 utilized the instructions and calibration data from the supplemental computer chip. The conventional "limp-home" chip 62 is also provided in this alternate embodiment for use by the ECM 16 if the supplemental computer chip 70 or the factory-programmed chip 64 cease to operate for any reason.

The specially preprogrammed computer chip 58 of the embodiment illustrated in FIG. 4 and the supplemental computer chip 70 of the alternate embodiment illustrated in FIG. 5 are programmed with data parameters for the particular engine that the ECM is controlling in order to provide air/fuel mixture having an air-to-fuel ratio in the range of approximately 20:1 to 45:1. Because many vehicle manufacturers use similar engine configurations for a wide range of vehicle models, similarly programmed computer chips with substantially the same instructions and calibration data can be used for all models having the similar engine configurations. As an example, one set of instructions and calibration data can be used in a wide range of Chevrolet vehicles, while a second set of instructions and calibration data can be used in a wide range of Ford vehicles. As a result, the present invention is highly effective as a retrofit product that is used to increase a conventional engine's power output and fuel efficiency, while decreasing emissions.

In yet another alternate embodiment (not shown), the ECM 16 has a memory device in the form of a permanent PROM, such as a flash EEPROM, that is programmable, erasable, and reprogrammable. When the present invention is incorporated in a vehicle during its original manufacture, the selected instructions and calibration data are originally programmed into the EEPROM. When the present invention is installed in a retrofit process, the EEPROM is erased and reprogrammed by conventional techniques to incorporate selected instructions and calibration data.

The structural components of the ECM 16 illustrated in FIGS. 4 and 5 are conventional components, except for the bridge 68 illustrated in FIG. 5, and these conventional components are interconnected in a conventional manner. In addition, the computer program architecture in the preprogrammed computer chip 58, the supplemental computer chip 70, and the limp-home chip 62 is also conventional. Accordingly, further description of the ECM's structural components and the program architecture is not provided. The preprogrammed computer chip 58 and the supplemental computer chip 70, however, include instructions, operating characteristics, and calibration data discussed below that are not provided in a conventional factory-programmed PROM in an ECM.

In one exemplary embodiment, a 1992 Chevrolet truck having an ECM 16 and a 350 hp, eight-cylinder engine (hereafter "the 350 Chevy engine") is provided with a computer chip 58 installed in the ECM (FIG. 4) and with the spark plugs 18 (FIG. 3) of the present invention. The computer chip 58 is programmed to provide and maintain an air-to-fuel ratio of approximately 20:1 or greater, and preferably in the range of 20:1 to 45:1, inclusive, and more preferably at approximately 30:1. "Air-to-fuel ratio" used herein is the weight ratio of an air-to-fuel (usually pounds to pounds or kilograms to kilograms) as the vapor form equivalent of given weights of air/fuel at standard temperature and pressure in accordance with standard industry practice. In a conventionally programmed computer chip for use with a similar 350 Chevy engine using conventional spark plugs, the computer chip is programmed to provide and maintain an air-to-fuel ratio of approximately 10:1 to 14.7:1. Accordingly, the air-to-fuel ratio programmed into the computer chip 58 for the engine incorporating the present invention is substantially higher (or leaner) than that of the conventionally programmed computer chip.

In the alternate embodiment illustrated in FIG. 5, the factory-programmed computer chip 64 and the ECM's program architecture for the 1992 Chevrolet truck is such that the maximum numerical value than can be used for the air-to-fuel ratio in the supplemental computer chip 70 is 25.5:1. Because the exemplary embodiment of the present invention utilizes an air-to-fuel ratio above the 25.5:1, e.g., approximately 30:1, the supplemental computer chip 70 is programmed with other instructions and calibration data that is typically used for a smaller engine that uses less fuel. As a result, the supplemental computer chip 70 provides even less fuel to the larger engine, than would normally be provided the 350 Chevy engine to achieve the 25.5:1 air-to-fuel ratio, thereby resulting in an actual higher air-to-fuel ratio during operation of the engine. As an example, the supplemental computer chip 70 is programmed with a base pulse width constant that is different from the factory setting, thereby changing how long the fuel injectors stay open. For the 350 Chevy engine, the base pulse width is changed from the factory setting of 135 to 129, thereby reducing the time in which the fuel injectors spray the gasoline into the intake manifold for each cycle. Accordingly, the supplemental computer chip 70 is programmed to provide an effective air-to-fuel ratio of approximately 30:1 even though that value is greater than the maximum available numerical set value of 25.5:1.

The preprogrammed computer chip 58 (FIG. 4) and the supplemental computer chip 70 (FIG. 5) of the two exemplary embodiments also control the engine's exhaust gas recirculation (EGR) system. When the EGR system is turned ON, the system recirculates exhaust gas back into the intake manifold in an attempt to burn unburned fuel that is in the exhaust gas. The preprogrammed computer chip 58 (FIG. 4) utilized in the present invention is programmed so that the EGR system remains turned OFF, so there is no recirculation of the exhaust gas. The EGR system is deactivated because the lean air/fuel mixture is substantially completely burned by the electric discharges generated by the spark plugs, discussed below, so exhaust recirculation is not necessary.

The EGR data parameters programmed in the supplemental computer chip 70 (FIG. 5) are set such that the engine's operating conditions will not reach the data parameters to activate the EGR system. Accordingly, the EGR system remains turned OFF. The supplemental computer chip 70 is also programmed to disable an EGR system diagnostic program provided in the factory-programmed computer chip 64, so the diagnostic program will not run during vehicle operation. For comparison purposes, the factory settings of the factory-programmed computer chip 64 (FIG. 5) are such that the EGR system is turned ON and OFF as a function of the engine's speed, temperature, throttle position, and manifold pressure, so the EGR system would be turned ON during a large portion of normal driving conditions using an engine without the present invention incorporated.

The factory settings of the factory-programmed computer chip 64 also has a block learn memory (BLM) program that is turned ON and OFF at different driving conditions to monitor data provided by a plurality of sensors in the engine. The BLM program modifies, in a conventional manner, particular data parameters in order to maintain the air-to-fuel ratio at the designated value (e.g., the factory setting of 14.7:1).

In the embodiment of the present invention utilizing the preprogrammed computer chip 58 (FIG. 4), the preprogrammed computer chip includes a BLM program that maintains the air-to-fuel ratio at the selected value in the range of approximately 20:1 to 45:1, inclusive, such as 30:1. In the alternate embodiment illustrated in FIG. 5, the supplemental computer chip 70 is programmed to override the factory-preprogrammed computer chip 64 and to keep the BLM program turned OFF.

The preprogrammed computer chip 58 (FIG. 4) and the supplemental computer chip 70 (FIG. 5) are also programmed with fuel tables that control how much fuel is provided to the intake manifold for mixing with the air to maintain the selected air-to-fuel ratio. The values in the fuel table are provided as a function of engine speed and manifold pressure. As best seen in Table 1, the fuel table for the 350 Chevy engine incorporating the present invention provides standard fuel values at engine speeds ranging from 400 rpm to 4800 rpm and for manifold pressures ranging from 20 KPa to 100 KPa. The illustrated fuel table has fuel values to maintain an air-to-fuel ratio of approximately 30:1. For purposes of comparison, Table 2 provides a full table with the standard fuel values for the same engine speeds and manifold pressures for the same 350 Chevy engine before being modified with the present invention.

TABLE 1

FUEL TABLE

| | MANIFOLD PRESSURE (KPa) | | | | | | | | | | | |
|---|---|---|---|---|---|---|---|---|---|---|---|---|
| RPM | 20 | 25 | 30 | 35 | 40 | 45 | 50 | 60 | 70 | 80 | 90 | 200 |
| 0 | 22 | 22 | 22 | 22 | 24 | 38 | 41 | 46 | 49 | 52 | 57 | 59 |
| 400 | 24 | 29 | 45 | 47 | 47 | 50 | 52 | 57 | 62 | 65 | 70 | 75 |
| 800 | 35 | 45 | 52 | 54 | 54 | 60 | 61 | 66 | 67 | 70 | 71 | 76 |
| 1200 | 38 | 48 | 61 | 61 | 69 | 69 | 70 | 73 | 75 | 76 | 77 | 77 |
| 1600 | 43 | 59 | 64 | 66 | 70 | 72 | 75 | 75 | 78 | 80 | 80 | 79 |
| 2000 | 49 | 63 | 71 | 74 | 75 | 75 | 75 | 79 | 82 | 84 | 84 | 82 |
| 2400 | 50 | 68 | 75 | 75 | 76 | 75 | 77 | 82 | 84 | 85 | 86 | 86 |
| 2800 | 50 | 69 | 76 | 76 | 77 | 77 | 80 | 85 | 86 | 87 | 86 | 87 |
| 3200 | 52 | 73 | 74 | 76 | 76 | 78 | 82 | 84 | 86 | 86 | 85 | 86 |
| 3600 | 52 | 72 | 73 | 73 | 73 | 77 | 80 | 84 | 84 | 82 | 85 | 85 |
| 4000 | 52 | 70 | 73 | 73 | 73 | 77 | 80 | 80 | 80 | 83 | 84 | 83 |
| 4400 | 52 | 70 | 73 | 73 | 73 | 77 | 80 | 80 | 80 | 83 | 83 | 83 |
| 4800 | 52 | 69 | 73 | 73 | 74 | 77 | 80 | 80 | 82 | 83 | 84 | 82 |

TABLE 2

FUEL TABLE PRIOR ART

| | MANIFOLD PRESSURE (KPa) | | | | | | | | | | | |
|---|---|---|---|---|---|---|---|---|---|---|---|---|
| RPM | 20 | 25 | 30 | 35 | 40 | 45 | 50 | 60 | 70 | 80 | 90 | 200 |
| 0 | 33 | 37 | 39 | 41 | 42 | 44 | 46 | 51 | 56 | 59 | 63 | 65 |
| 400 | 35 | 38 | 53 | 56 | 57 | 56 | 57 | 63 | 68 | 71 | 76 | 81 |
| 800 | 37 | 46 | 53 | 56 | 57 | 66 | 68 | 72 | 73 | 76 | 78 | 82 |
| 1200 | 41 | 54 | 64 | 66 | 75 | 75 | 76 | 79 | 82 | 82 | 84 | 83 |
| 1600 | 49 | 66 | 71 | 73 | 76 | 78 | 80 | 82 | 84 | 86 | 87 | 86 |
| 2000 | 55 | 69 | 78 | 80 | 81 | 81 | 81 | 85 | 88 | 90 | 90 | 88 |
| 2400 | 57 | 74 | 81 | 82 | 82 | 81 | 83 | 88 | 90 | 91 | 93 | 93 |
| 2800 | 57 | 75 | 82 | 82 | 83 | 84 | 86 | 91 | 92 | 93 | 93 | 93 |
| 3200 | 59 | 79 | 80 | 82 | 82 | 84 | 88 | 90 | 92 | 92 | 92 | 92 |
| 3600 | 59 | 78 | 79 | 79 | 79 | 83 | 87 | 90 | 90 | 89 | 92 | 92 |
| 4000 | 59 | 76 | 79 | 79 | 79 | 83 | 87 | 87 | 87 | 89 | 90 | 90 |
| 4400 | 59 | 76 | 79 | 79 | 79 | 83 | 87 | 87 | 87 | 89 | 90 | 90 |
| 4800 | 59 | 76 | 79 | 79 | 79 | 83 | 87 | 87 | 87 | 89 | 90 | 90 |

A comparison between Tables 1 and 2 shows that, for each operating condition, less fuel is provided into the combustion chamber for the 350 Chevy engine with the present invention installed (Table 1) than for the same engine without the invention (Table 2). Testing of the 350 Chevy engine with the present invention installed had has demonstrated an increased fuel efficiency of approximately 30% to 80% while still achieving an increase in power output and a decrease in engine emissions as compared to the same engine without the present invention.

Each of the preprogrammed computer chip 58 (FIG. 4) and the supplemental computer chip 70 (FIG. 5) is also programmed with a spark timing table that controls when electrical current is provided to the spark plug 18 (FIG. 3) from a conventional coil, such as a 15,000 volt coil, in order to generate a spark at the spark plug. The timing for spark generation is also a function of the engine's manifold pressure and the engine's speed. The timing for spark generation relative to the piston's position in the chamber is expressed in the spark timing table in a conventional manner as the number of degrees before the piston's top-dead-center position (i.e., at the top of the piston's stroke). Accordingly, a value of 0 (zero) in the spark timing table indicates spark generation at top-dead-center.

An exemplary spark timing table for the 350 Chevy engine with the present invention installed is illustrated in Table 3 (below). For comparison purposes, a spark timing table with factory settings for the same 350 Chevy engine without the present invention is illustrated in Table 4 (below).

TABLE 3

SPARK TIMING TABLE

| | MANIFOLD PRESSURE (KPa) | | | | | | | | | | | | | | |
|---|---|---|---|---|---|---|---|---|---|---|---|---|---|---|---|
| RPM | 30 | 35 | 40 | 45 | 50 | 55 | 60 | 65 | 70 | 75 | 80 | 85 | 90 | 95 | 100 |
| 400 | 0 | 0 | 0 | 0 | 0 | 0 | 0 | 0 | 0 | 1 | 1 | 1 | 1 | 1 | 1 |
| 600 | 0 | 0 | 0 | 0 | 0 | 0 | 0 | 0 | 0 | 1 | 1 | 1 | 1 | 1 | 2 |
| 800 | 0 | 0 | 0 | 0 | 0 | 0 | 0 | 0 | 0 | 1 | 3 | 3 | 4 | 5 | 6 |
| 1000 | 9 | 8 | 9 | 7 | 7 | 7 | 8 | 7 | 7 | 6 | 6 | 5 | 5 | 6 | 6 |
| 1200 | 10 | 9 | 9 | 9 | 9 | 7 | 6 | 6 | 6 | 6 | 7 | 6 | 5 | 6 | 7 |
| 1600 | 10 | 10 | 10 | 10 | 9 | 10 | 10 | 9 | 6 | 6 | 6 | 7 | 6 | 7 | 7 |
| 2000 | 10 | 10 | 10 | 10 | 10 | 10 | 10 | 10 | 10 | 9 | 6 | 7 | 6 | 7 | 7 |
| 2400 | 10 | 10 | 10 | 10 | 10 | 10 | 10 | 10 | 10 | 10 | 8 | 7 | 6 | 7 | 7 |
| 2800 | 11 | 10 | 10 | 10 | 10 | 10 | 10 | 10 | 10 | 10 | 9 | 7 | 6 | 7 | 7 |
| 3200 | 11 | 10 | 11 | 11 | 10 | 10 | 11 | 10 | 10 | 10 | 10 | 7 | 6 | 7 | 7 |
| 3600 | 11 | 11 | 11 | 12 | 10 | 10 | 10 | 11 | 10 | 10 | 10 | 8 | 7 | 7 | 7 |
| 4000 | 11 | 10 | 11 | 11 | 10 | 10 | 11 | 11 | 11 | 10 | 10 | 8 | 8 | 7 | 7 |
| 4400 | 11 | 11 | 11 | 11 | 10 | 11 | 11 | 11 | 11 | 11 | 10 | 8 | 8 | 7 | 7 |

TABLE 4

SPARK TIMING TABLE - PRIOR ART

| | MANIFOLD PRESSURE (KPa) | | | | | | | | | | | | | | |
|---|---|---|---|---|---|---|---|---|---|---|---|---|---|---|---|
| RPM | 30 | 35 | 40 | 45 | 50 | 55 | 60 | 65 | 70 | 75 | 80 | 85 | 90 | 95 | 100 |
| 400 | 16 | 16 | 16 | 16 | 16 | 16 | 15 | 11 | 8 | 6 | 4 | 1 | 2 | −3 | −4 |
| 600 | 16 | 16 | 16 | 16 | 16 | 16 | 15 | 11 | 8 | 6 | 4 | 1 | −2 | −3 | −4 |
| 800 | 16 | 16 | 16 | 16 | 16 | 16 | 15 | 13 | 10 | 7 | 5 | 3 | 1 | −1 | −2 |
| 1000 | 18 | 18 | 18 | 18 | 18 | 18 | 18 | 16 | 13 | 10 | 7 | 5 | 4 | 3 | 3 |
| 1200 | 21 | 21 | 21 | 21 | 21 | 20 | 20 | 17 | 15 | 13 | 9 | 8 | 7 | 6 | 6 |
| 1600 | 23 | 23 | 23 | 23 | 23 | 23 | 23 | 20 | 17 | 15 | 13 | 12 | 11 | 10 | 10 |
| 2000 | 25 | 25 | 25 | 25 | 25 | 24 | 24 | 22 | 19 | 16 | 14 | 14 | 12 | 11 | 11 |
| 2400 | 26 | 26 | 26 | 26 | 26 | 26 | 25 | 23 | 20 | 17 | 15 | 14 | 13 | 12 | 12 |
| 2800 | 27 | 27 | 27 | 27 | 27 | 27 | 26 | 25 | 21 | 18 | 16 | 15 | 14 | 13 | 13 |
| 3200 | 29 | 29 | 29 | 29 | 29 | 28 | 27 | 25 | 22 | 19 | 18 | 16 | 15 | 14 | 14 |
| 3600 | 30 | 30 | 30 | 30 | 30 | 29 | 28 | 26 | 23 | 21 | 20 | 18 | 18 | 16 | 16 |
| 4000 | 30 | 30 | 30 | 30 | 30 | 30 | 29 | 27 | 24 | 22 | 21 | 19 | 18 | 17 | 17 |
| 4400 | 30 | 30 | 30 | 30 | 30 | 30 | 29 | 27 | 24 | 23 | 22 | 20 | 19 | 18 | 18 |

The spark timing table in each of the preprogrammed computer chip 58 FIG. 4) and the supplemental computer chip 70 (FIG. 5) is configured so the spark plug 8 (FIG. 3) generates a spark and detonates the air/fuel mixture when the piston is at or within at least 11 degrees before top-dead-center. As a result, the 350 Chevy engine with the present invention installed achieves an increased power output upon burning less fuel in the lean air/fuel mixture.

A comparison between Table 3 and Table 4 shows that the spark timing table in the preprogrammed computer chip 58 (FIG. 4) or the supplemental computer chip 70 (FIG. 5) is set so a spark is generated when the piston is closer to top-dead-center than typically occurs in the conventional engine without the present invention for the same manifold pressure and engine speed. The exception occurs only at higher pressure (between 90 KPa–100 KPa) with the lower engine speed (between 800–1200 rpm).

The present invention also allows the engine to run cooler than when the present invention is not incorporated in the engine. Testing has demonstrated that the exhaust temperatures in the 350 Chevy engine's exhaust manifold were reduced by approximately 44.9% to 46.7% as compared to the exhaust temperatures for the same 350 Chevy engine without the present invention. The 350 Chevy engine with the present invention installed had exhaust temperatures of approximately 319° F. to 360° F., while the same engine without the present invention and at factory settings had exhaust temperature of approximately 535° F. to 600° F. when running for the same period of time. Accordingly, the engine with the present invention installed operates at significantly lower temperatures. In addition, it is understood that these reduced exhaust temperatures also reduces formation and emission of $NO_x$ during operation of the engine.

Figure 6:
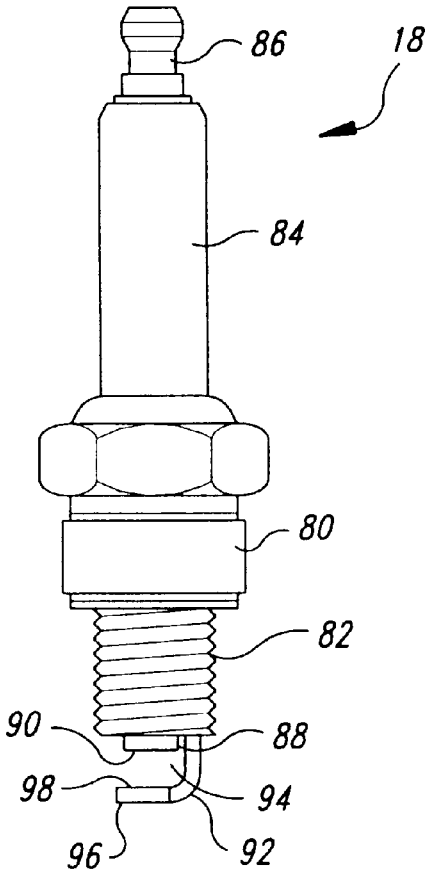
FIG. 6 is an enlarged side elevation of the spark plug of FIG. 3.

To achieve the increased power and fuel efficiency with decreased emissions as indicated above, the air/fuel mixture having the 20:1 to 45:1 air-to-fuel ratio is detonated by an enlarged high energy electric discharge from the spark plug 18 of the present invention so as to achieve a fast and substantially complete combustion of the air/fuel mixture. As best seen in FIG. 6, the spark plug 18 has a metal shell 80 with a threaded metal lower body 82 extending from the shell's lower end, and a porcelain insulator 84. The porcelain insulator 84 extends through the threaded lower body 82, through the metal shell 80, and upwardly from an upper portion of the metal shell. A top terminal 86 projects upwardly through and beyond the porcelain insulator 84. The top terminal 86 is adapted to connect to a conventional spark plug wire (not shown) that is coupled to a conventional coil (not shown), such as a conventional 15,000 volt coil that provides electrical current to the spark plug 18.

The top terminal 86 is electrically connected to a center electrode 88 that extends downwardly through the porcelain insulator 84 and terminates at a position below the porcelain insulator 84. The center electrode's bottom end has an enlarged sparking surface 90 that is spaced axially apart from a ground electrode 92, which is connected to the threaded lower body 82 of the spark plug 18. The center electrode's sparking surface 90 is spaced apart from the ground electrode 92 by an enlarged electric discharge gap 94, also referred to as a spark gap.

The center electrode 88 is a generally cylindrical conductive member with the sparking surface 90 having a diameter in the range of approximately 4.0 mm to 7.5 mm, inclusive, and more preferably in the range of approximately 4.0 mm to 6.7 mm, inclusive, and even more preferably in the range of 4.0 mm to 4.5 mm, inclusive. In one exemplary embodiment illustrated in FIG. 6, the center electrode's sparking surface 90 has a diameter of approximately 4.0 mm. The center electrode 88 has a substantially constant diameter along its length, although alternate embodiments include a center electrode with an enlarged bottom end that includes the sparking surface 90 thereon, with the rest of the center electrode having a smaller cross-sectional area.

Figure 8:
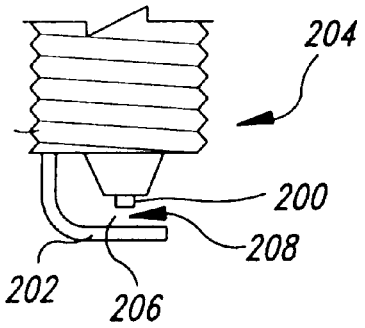
Fig. 8 (PRIOR ART)
FIG. 8 is a partial side elevational view of a conventional prior art spark plug having center and ground electrodes, the electrodes being shown with a spark arcing therebetween.

For illustrative purposes, a center electrode 200 and ground electrode 202 of a conventional spark plug 204 are illustrated in FIG. 8. The conventional center electrode 200 has a diameter of approximately 2.0 mm. In comparing the spark plug 18 of the exemplary embodiment of the present invention (FIG. 6) to the conventional spark plug 204 (FIG. 8), the exemplary embodiment's center electrode 88 and its sparking surface 90 has a diameter that is approximately 2.0 to 3.75 times greater than a conventional spark plug's center electrode 200. The cross-sectional area of the center electrode 88 and the surface area of the sparking surface are approximately 12.568 $mm^2$ to 44.156 $mm^2$, which is approximately 4.0 to 14.053 times greater than the 3.142 $mm^2$ cross-sectional area of the conventional spark plug's center electrode 200.

The spark plug 18 of the exemplary embodiment has the center electrode 88 made of nickel-chromium-iron alloy, preferably Inconel 600. In alternate embodiments, the center electrode 88 is made of other conductive materials including platinum, silver, steel, or other metal alloys.

Figure 7:
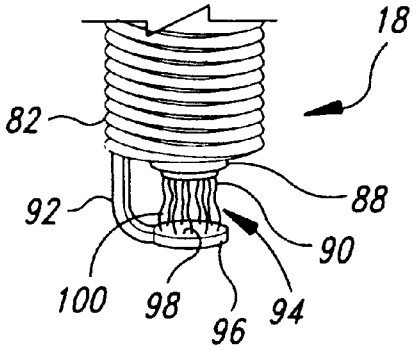
FIG. 7 is an enlarged side isometric view of a center electrode and a ground electrode of the spark plug of FIG. 6 with a plurality of sparks generated within a selected time period being shown in a fuel detonation area.

As best seen in FIG. 7, the ground electrode 92 of the present invention is L-shaped and is connected at one end to the threaded lower body 82. The ground electrode 92 has a generally cylindrically-shaped free end portion 96 with a spark grounding surface 98 that is spaced axially apart from the center electrode's sparking surface 90 by the electric discharge gap 94. The ground electrode's free end portion 96 and its spark grounding surface 98 have a diameter in the range of approximately 4.0 mm to 7.5 mm, inclusive. For purposes of comparison, the conventional ground electrode 202 illustrated in FIG. 8 has a free end with a width of approximately 2 mm to 3 mm.

The ground electrode's spark grounding surface 98 illustrated in FIGS. 6 and 7 has a surface area that is substantially equal to or greater than the surface area of the center electrode's sparking surface 90. In the exemplary embodiment, the center electrode's sparking surface 90 and the ground electrode's spark grounding surface 98 are substantially flat and parallel to each other and have diameters of approximately 4.5 mm. Accordingly, the sparking surface 90 and the spark grounding surface 98 has approximately the same surface areas between which the electric discharges arc during operation of the engine.

The spark gap 94 extending between the sparking surface 90 and the spark grounding surface 98 has a length of at least approximately 1.8 mm, and more preferably in the range of approximately 2.0 mm to 3.0 mm, inclusive. In the exemplary embodiment, the spark gap 94 is approximately 2.0 mm. For comparison purposes, the spark gap 206 of the conventional spark plug 204 shown in FIG. 8 is approximately 0.8 mm. Accordingly, the spark gap 94 of the exemplary embodiment's spark plug 18 is approximately 2.25 to 3.75 times larger than the conventional spark gap. The enlarged spark gap 94 is combined with the center electrode's sparking surface and the ground electrodes spark grounding surface 98 to define an enlarged cylindrically-shaped detonation area 100 having a volume of approximately 22.62 $mm^3$ or greater through which the electrical discharges extend during operation of the spark plug 18.

The enlarged spark gap 94 of the present invention's spark plug 18 in combination of the center electrode's enlarged sparking surface 90 allow for a greater build up of electrical charges on the center electrode's sparking surface 90 before the voltage reaches the ionization point of the gas or air/fuel mixture in the spark gap. Once the ionization point is reached the electrical charges jump across the gap in the form of one or more electric discharges. Accordingly, the enlarged surface area of the center electrode's sparking surface 90 provides a capacitance effect that enables more energy to be stored and generally simultaneously released up on reaching the ionization point, thereby resulting in a high energy electric discharge between the center and ground electrodes 88 and 92. Accordingly, the electrical discharge that arcs across the spark gap 94 of the spark plug 18 is larger, hotter, and more powerful than a spark generated from a conventional spark plug.

The enlarged, hot and powerful electric discharge generated by the spark plug 18 causes a faster detonation of the lean air/fuel mixture in the combustion chamber, which provides a faster flame front growth through the air/fuel mixture and greater power output from the engine. The detonation is faster because more of the air/fuel mixture is detonated simultaneously so the time required to burn the rest of the mixture is less. The enlarged, hot and powerful electric discharge also results in substantially complete combustion of the lean air/fuel mixture, thereby minimizing emissions from the engine.

For purposes of comparison, the conventional spark plug 204 shown in FIG. 8 has the small gap of 0.8 mm and a center electrode with a smaller sparking surface, which requires less energy at the center electrode 200 in order to reach the ionization point of the gas or air/fuel mixture in the spark gap 206. Accordingly, a less powerful, thin spark 208 is sufficient to jump the spark gap. The less powerful spark typically has a blue or partially orange color in atmospheric conditions. When the spark is created under compression, such as 120 psi, the low power spark is diminished and difficult to see.

Testing has shown that the spark plug 18 of the present invention in atmospheric conditions generates large, white electric discharges that arc across the enlarged spark gap 94. The white electric discharge is a hotter, higher energy and more powerful discharge than a blue or orange spark provided by the conventional spark plug. The present invention spark plug's white electric discharge also has a length that is roughly 2.25 to 3.75 times the length of the conventional spark plug's blue or orange spark. Accordingly, the spark plug 18 of the present invention creates a high energy, hot electric discharge with an increased surface area for substantially simultaneous detonation of more of the air/fuel mixture, thereby requiring less time to detonate substantially all of the air/fuel mixture in the combustion chamber. Testing has also shown that the large, white electric discharges generated by the spark plug 18 become brighter and appear to plume or expand radially under compression, such as up to 120 psi. Accordingly, the performance of the spark plug 18 appears to be enhanced rather than diminished under compression.

Testing has further shown that, in a selected time period, such as 1/60th or 1/125th of a second, the spark plug 18 under compression conditions of approximately 120 psi generate a plurality of high energy white electric discharges in the detonation area. The spark plug 18 creates these electric discharges from electrical current from a conventional 15,000 volt to 30,000 volt coil that is typically used to drive the conventional spark plugs. Accordingly, the spark plugs 18 do not require a higher voltage coil be used when retrofitted into a vehicle in order to achieve the benefits of the present invention.

Voltage testing has demonstrated that the spark plug 18 of the exemplary embodiment having nickel-chromium-iron alloy, preferably Inconel 600 center electrode 88 with a 4.5 mm diameter sparking surface 90 axially spaced apart from the ground electrode's spark grounding surface 98 by approximately a 2.0 mm spark gap 94, requires only 3 kilovolts (KV) to generate high energy white electric discharge across the spark gap 94 at approximately atmospheric conditions. The same spark plug 18 required 6 KV to generate the electric discharge across the spark gap 94 at approximately 120 psi.

The same voltage testing was conducted with four conventional spark plugs including ACCEL, A/C Delco, Splitfire and Silverstone spark plugs, each of which had the much smaller spark gaps of approximately 0.76 mm to 0.8 mm. The ACCCEL spark plug required 3 KV to spark at atmosphere conditions and 4 KV to spark at 120 psi. The A/C Delco spark plug required 5 KV to spark at atmospheric conditions and 8 KV to spark at 120 psi. The Splitfire required 6 KV to spark at atmospheric conditions and 9 KV to spark at 120 psi. The Silverstone with the silver center electrode required 7 KV to spark at atmospheric and 10 KV to spark at 120 psi.

The spark plugs 18 of the present invention also allow the engine to run cooler than the same engine utilizing conventional spark plugs. The spark plug 18 generates the larger, hotter, higher energy electric discharge, which explosively detonates the air/fuel mixture faster than a conventional spark plug. As a result, more of the air/fuel mixture is substantially simultaneously detonated and the flame front growth is faster so less time is required to substantially completely burn the air/fuel mixture. In addition, the larger, hotter, high energy electric discharge transfers more thermal energy to the air/fuel mixture, thereby accelerating the flame front growth and providing the more efficient and complete combustion. Further, more of the heat or thermal energy generated by the combustion is converted into kinetic energy that drives the piston on the downstroke in the cylinder. Accordingly, the exhaust temperature is lower and the engine runs cooler.

As best seen in FIG. 3, the spark plug 18 is typically positioned with the enlarged center electrode 88 and the ground electrode 92 at the top of the combustion chamber 17. The spark plug 18 produces the enlarged, white, high energy electric discharges that extend across the spark gap 94 and explosively detonate the lean air/fuel mixture, thereby driving the piston 30 from approximately top-dead-center in the piston cylinder 29 downwardly on the down stroke to achieve the increased power from the engine.

The vehicle having the 350 Chevy engine with the ECM being configured to provide an air-to-fuel ratio of approximately 30:1 and with the improved spark plugs 18 of the present invention has been tested and has demonstrated a power increase of approximately 25% to 30%, along with a fuel efficiency increase by approximately 30% to 80% for different driving conditions. Testing of the 350 Chevy engine's emissions has also demonstrated a reduction of the engine's hydrocarbon emissions from 161 parts per million (ppm) to 6 ppm at idle (800 rpm) and from 18 ppm to 3 ppm at cruise (2400 rpm). The engine's emissions of carbon monoxide was reduced from 0.06% down to 0.0% at idle and from 0.03% down to 0.0% at cruise. Accordingly, the engine with the present invention installed demonstrated an increase in power and fuel efficiency and a decrease in emissions.

Figure 9:
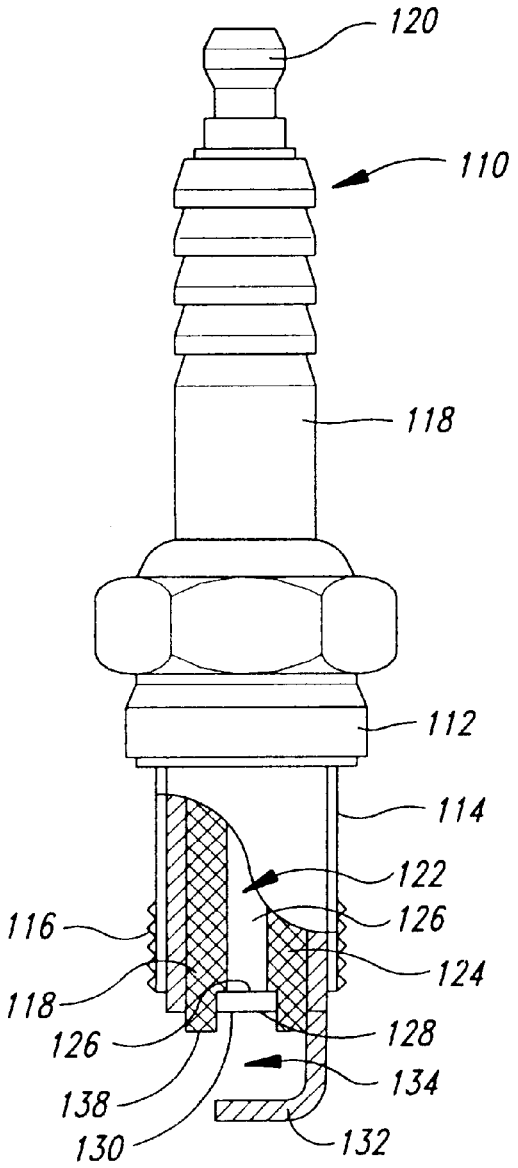
FIG. 9 is partially fragmented side elevation view of an alternate embodiment of the spark plug of FIG. 1.

As best seen in FIG. 9, a spark plug 110 of an alternate embodiment of the present invention has a metal shell 112 having a lower body 114 with a threaded lower end 116. A porcelain insulator 118 extends through the metal shell 112 and away from an upper portion of the metal shell 112. A top terminal 120 projects out of the top of the porcelain insulator 118, and the top terminal is connected to a center electrode 122 that extends downwardly through the porcelain insulator and the threaded lower body 114. The porcelain insulator 118 has a lower insulating sleeve 124 that extends through the metal shell's threaded lower body 114 so as to insulate the center electrode 122 from the metal shell 112.

The center electrode 122 has a shaft portion 126 that extends from the top terminal 120 through the lower insulating sleeve 124 and terminates at an enlarged bottom end portion 128. The center electrode's bottom end portion 128 has a flat sparking surface 130 that is spaced apart from a ground electrode 132 by an enlarged electric discharge gap 134. In the illustrated embodiment, the center electrode's shaft portion 126 has a diameter in the range of approximately 3 mm, and the center electrode's bottom and portion 128 has a diameter in the range of approximately 4.0 mm to 7.5 mm, inclusive. In an alternate embodiment (not shown), the shaft portion 126 and the bottom end portion 128 have a diameter in the range of approximately 4.0 mm to 7.5 mm, such that there is no size difference to distinguish the shaft portion from the bottom end portion.

As best seen in FIG. 9, the center electrode's bottom end portion 128 is recessed within a lower end 138 of the lower insulating porcelain sleeve 124. The insulating sleeve 124 extends through the metal shell's threaded lower body 114, past the center electrode's bottom end portion 128, and terminates at a position between the bottom end portion 128 and the ground electrode 132. Accordingly, the bottom end portion's sparking surface 130 is recessed within the lower insulating sleeve's lower end 138 by a selected distance. In the illustrated embodiment of FIG. 9, the bottom end portion's sparking surface is recessed within the porcelain sleeve's lower end 130 by a distance of approximately 0.5 mm. The depth of recess, however, for other embodiments are greater or less than 0.5 mm.

The recessed sparking surface 130 faces the ground electrode 132 so an electric discharge generated by the spark plug 110 extends between the sparking surface and the ground electrode 132 without arcing to the threaded lower body 114. In the illustrated embodiment, the sparking surface 130 is spaced apart from the ground electrode 132 to define the electric discharge gap 134 at approximately 3.0 mm. In alternate embodiments, the electric discharge gap 134 is at least 2.5 mm or greater.

The spark plug 110 of this alternate embodiment maintains an exterior size and configuration that allows for easy retrofit into a conventional engine because the ground electrode 132 is not extended substantially farther away from the spark plug's threaded lower body 114 than a conventional spark plug in order to achieve an increased gap size. As a result, the spark plug 110 provides the center electrode 122 having a large sparking surface 130 that allows for an enlarged, high energy electric discharge to extend across the gap 134, thereby resulting in the faster and more efficient detonation of the lean air/fuel mixture.

Figure 10:
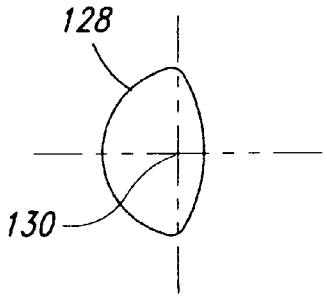
FIG. 10 is an enlarged bottom plan view of a center electrode of the spark plug of FIG. 9.

As best seen in FIG. 10, an alternate embodiment of the center electrode's bottom end portion 128 has the sparking surface 130 with a generally oval or rounded D-shape to provide a relatively large surface area facing the ground electrode. Other shapes can be used for the sparking surface 130 to provide the enlarged, high energy electric discharge.

Figure 11:
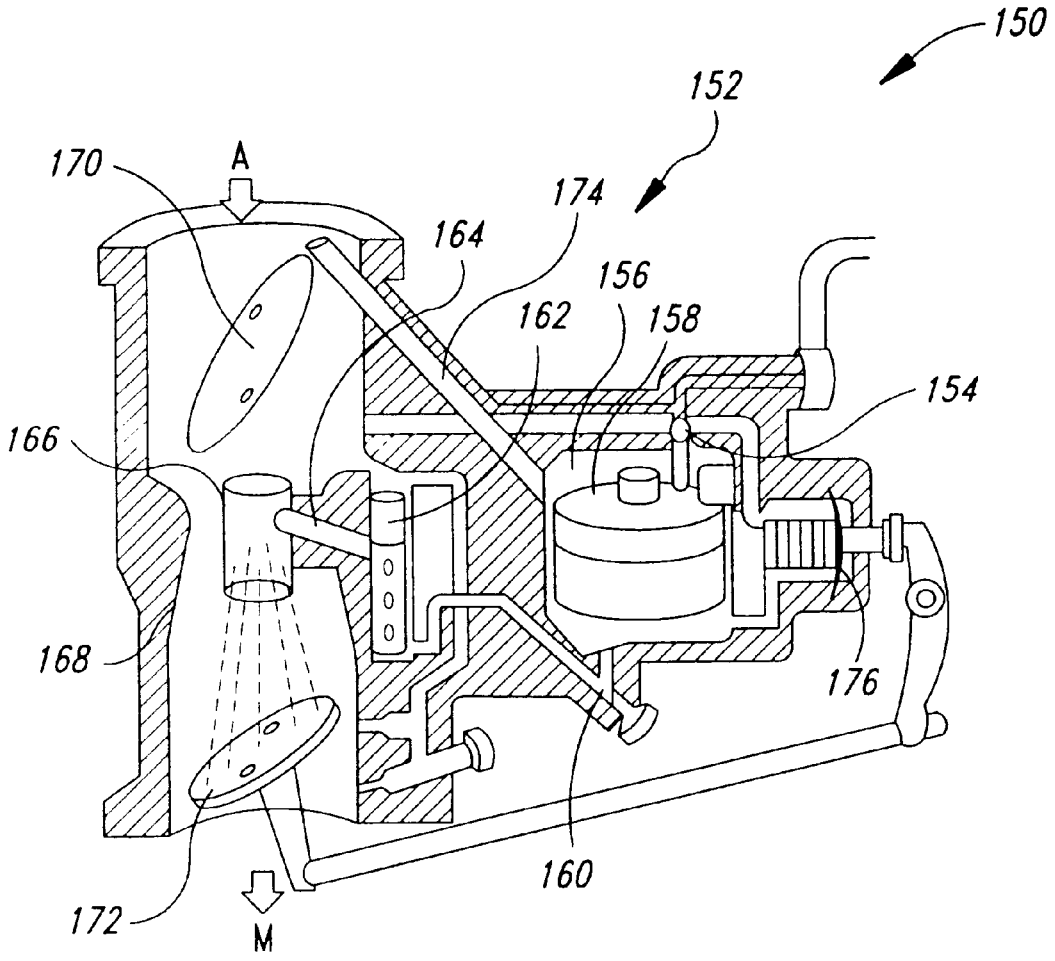
FIG. 11 is a schematic view showing an alternative fuel delivery system of the engine of FIG. 1, the fuel delivery system having a carburetor therein.

As best seen in FIG. 11, an alternate embodiment has an internal combustion engine 150 with a carburetor 152 that meters fuel flow to control the amount of fuel mixed with air and delivered to the combustion chamber and to control the air-to-fuel ratio of the air/fuel mixture. The illustrated carburetor 152 is a fixed-venturi carburetor having a needle valve 154, a float chamber 156, a float 158, a main jet 160, an air bleeder 162, a modified main nozzle 164, a small venturi 166, a large venturi 168, a choke valve 170, a throttle valve 172, an air vent 174, and an accelerating pump 176 of conventional design. The reference characters A and M designate air and air/fuel mixture directional flow, respectively. The modified main nozzle 164 has a very small outlet opening that restricts the flow of fuel therethrough to provide a very lean air/fuel mixture. The main nozzle 164 of one embodiment is an outlet aperture that is sized to allow the fuel to pass therethrough and mix with air to provide an air-to-fuel ratio of at least 20:1, and preferably in the range of approximately 20:1 to 45:1, inclusive.

The finely atomized fuel discharged from the main nozzle 164 is mixed with oxygen of the air A and the resulting air/fuel mixture M is passed by the throttle valve 172 and into the combustion chamber (not shown). In the embodiment with the carburetor 152, the internal combustion engine 150 includes spark plugs 18 that produce the enlarged, high energy electric discharge discussed above.

Each spark plug 18 is positioned to create the electric discharge in the combustion chamber. The air/fuel mixture M in the combustion chamber is detonated by the enlarged, hot electric discharge, and the air/fuel mixture is quickly, explosively and efficiently burned to produce increased power with decreased engine emissions while maintaining an increased fuel efficiency.

The spark plug 18 of the present invention as illustrated in FIGS. 3, 6, 7, 9 and 10 is adapted to be installed as retrofit procedure in a conventional internal combustion engine having a fuel injection system or a carburetor. Accordingly, an existing internal combustion engine is retrofitted by replacing the conventional spark plugs with the spark plugs 18 of the present invention. The carburetor or fuel injection system is adjusted either manually or by modifying the ECM or other control assembly to provide an air-to-fuel ratio within the range of approximately 20:1 to 45:1.

Accordingly, the present invention results in a high fuel combustion efficiency, and a substantially increased fuel efficiency. In addition, the internal combustion engine runs cooler, and the emissions of undesirable gases are substantially reduced as compared to a conventional engine. As a result, components on internal combustion engines for reducing emissions, such as catalytic converters, can be eliminated. Furthermore, because the internal combustion engine with the fuel supplying assembly of the present invention is not contaminated with carbon or the like due to the virtually complete fuel combustion, the engine's life is lengthened. Further, the contamination to an exhaust muffler is also lessened.

Numerous modifications and variations of the invention disclosed herein will occur to those skilled in the art in view of this disclosure. Therefore, it is to be understood that modifications, variations, and equivalents thereof may be practiced while remaining within the spirit and scope of the invention as defined by the following claims.

What is claimed is:

1. An internal combustion engine assembly powered by fuel from a fuel source, comprising:

an engine having a piston cylinder with a fuel combustion chamber and an air/fuel mixing area that communicates with the combustion chamber for delivering an air/fuel mixture to the combustion chamber;

a fuel delivery system connected to the engine and coupled to the fuel source, the fuel delivery system delivering a selected amount of fuel into the mixing area for mixing with air to form the air/fuel mixture; and an electric discharge generating device connected to the engine and positioned to generate an electric discharge in the combustion chamber, wherein said electric discharge generating device is a spark plug having a center electrode and a ground electrode spaced axially apart and wherein said center electrode has a substantially flat sparking surface, said sparking surface having a surface area of approximately at least 12.56 $mm^2$, and said ground electrode has a substantially flat grounding surface that is parallel to and faces said sparking surface and such that there is an electric discharge gap having a length of approximately at least 2.0 mm and being positioned to detonate the air/fuel mixture upon generation of an electric discharge across the electric discharge gap.

2. The internal combustion engine assembly of claim 1 wherein the fuel delivery system includes a fuel injector and a fuel line connecting the fuel injector to the fuel source, and the fuel delivery system includes a fuel flow controlling device controlling the amount of fuel flowing through the fuel injector.

3. The internal combustion engine assembly of claim 2 wherein the fuel flow controlling device is an electronic control module including a memory programmed with selected data for controlling the amount of fuel to provide the air-to-fuel ratio of approximately at least 20:1.

4. The internal combustion engine assembly of claim 1 wherein the selected amount of fuel delivered by the fuel delivery system is an amount to provide an air-to-fuel ratio in the range of approximately 20:1 to 45:1, inclusive.

5. The internal combustion engine assembly of claim 1 wherein said grounding surface has a surface area substantially equal to or greater than the surface area of said sparking surface.

6. The internal combustion engine assembly of claim 5 wherein the center electrode has a diameter of approximately 4.0 mm.

7. The internal combustion engine assembly of claim 1 wherein the center electrode is a nickel-chromium-iron steel alloy electrode.

8. The internal combustion engine assembly of claim 1 wherein said center electrode has a diameter in the range of approximately 4.0 mm to 7.5 mm, inclusive.

9. The internal combustion engine of claim 1 wherein said electric discharge gap has a length in the range of approximately 2.0 mm to 3.0 mm, inclusive.

10. A fuel saving and power increasing assembly for connecting to an internal combustion engine, the engine having a fuel delivery system that provides fuel for an air/fuel mixture that is delivered to a combustion chamber, the fuel delivery system being coupled to an electronic control module that controls fuel delivery to form the air/fuel mixture, comprising:

a memory device connectable to the electronic control module, the memory device being programmed with selected data to control formation of the air/fuel mixture; and an electric discharge device connectable to the engine adjacent to the combustion chamber, wherein said electric discharge generating device is a spark plug having a center electrode and a ground electrode spaced axially apart and wherein said center electrode has a substantially flat sparking surface, said sparking surface having a surface area of approximately at least 12.56 $mm^2$, and said ground electrode has a substantially flat grounding surface that is parallel to and faces said sparking surface and such that there is a gap having a distance of approximately at least 2.0 mm, said electric discharge generating device being adapted to generate an electric discharge across the gap to detonate the air/fuel mixture.

11. The assembly of claim 10 wherein the memory device is a computer chip removably connected to the electronic control module, the chip being programmed with the selected data to provide an air-to-fuel ratio of approximately at least 20:1.

12. The assembly of claim 10 wherein said grounding surface has a surface area substantially equal to or greater than the surface area of said sparking surface.

13. The assembly of claim 12 wherein the center electrode has a diameter of approximately at least 4.0 mm.

14. The assembly of claim 10 wherein the gap has a distance in the range of approximately 2.0 mm to 3.0 mm.

15. A spark plug, comprising:

a body, an insulator connected to the body and terminating at an open end portion;

a center electrode connected to the insulator and out of electrical contact with the body, the center electrode having at one end a sparking surface that is recessed a selected distance within the open end portion of the insulator wherein said sparking surface has a surface area of approximately at least 12.568 $mm^2$; and a ground electrode connected to the body and having a spark grounding surface facing the sparking surface of the center electrode and spaced apart therefrom by a selected distance to define a spark gap therebetween that extends partially within the open end portion of the insulator wherein said spark grounding surface has a surface area substantially equal to or greater than the surface area of said sparking surface.

16. The spark plug of claim 15 wherein the center electrode is a nickel-chromium-iron steel alloy electrode.

17. A spark plug, comprising:

a body, an insulator connected to the body and terminating at an open end portion;

a center electrode connected to the insulator and out of electrical contact with the body, the center electrode having at one end a sparking surface that is recessed a selected distance within the open end portion of the insulator wherein said sparking surface has a diameter of at least approximately 4.0 mm; and a ground electrode connected to the body and having a spark grounding surface facing the sparking surface of the center electrode and spaced apart therefrom by a selected distance to define a spark gap therebetween that extends partially within the open end portion of the insulator wherein said spark grounding surface has a surface area substantially equal to or greater than the surface area of said sparking surface.

18. A spark plug, comprising:

a body, an insulator connected to the body and terminating at an open end portion;

a center electrode connected to the insulator and out of electrical contact with the body, the center electrode having at one end a sparking surface that is recessed a selected distance within the open end portion of the insulator such that there is a spark gap wherein the spark gap is at least approximately 2.0 mm; and a ground electrode connected to the body and having a spark grounding surface facing the sparking surface of the center electrode and spaced apart therefrom by a selected distance to define a spark cap therebetween that extends partially within the open end portion of the insulator wherein said spark grounding surface has a surface area substantially equal to or greater than the surface area of said sparking surface.

19. A spark plug, comprising:

a body, an insulator connected to the body and terminating at an open end portion;

a center electrode connected to the insulator and out of electrical contact with the body, the center electrode having at one end a sparking surface that is recessed a selected distance within the open end portion of the insulator such that there is a spark gap wherein the spark gap is in the range of approximately 2.0 mm to 3.0 mm, inclusive; and a ground electrode connected to the body and having a spark grounding surface facing the sparking surface of the center electrode and spaced apart therefrom by a selected distance to define a spark gap therebetween that extends partially within the open end portion of the insulator wherein said spark grounding surface has a surface area substantially equal to or greater than the surface area of said sparking surface.

20. A method of detonating an air/fuel mixture in a combustion chamber of an internal combustion engine, comprising the steps of:

providing to the combustion chamber an air/fuel mixture having a selected air-to-fuel ratio of at least 20:1;

generating an electric discharge within the combustion chamber with an electric discharge generating device having a center electrode and a ground electrode spaced axially apart and wherein said center electrode has a substantially flat sparking surface and said ground electrode has a substantially flat grounding surface that is parallel to and faces said sparking surface and such that there is a selected discharge gap of at least 1.8 mm, the sparking surface having a surface area of at least 12.5658 $mm^2$; and detonating the air/fuel mixture with the electric discharge.

21. The method of claim 20 wherein the step of providing an air/fuel mixture includes providing the air/fuel mixture with the selected air-to-fuel ratio in the range of approximately 20:1 to 45:1, inclusive.

22. The method of claim 20 wherein the step of generating an electric discharge includes generating the electric discharge across the discharge gap having a length in the range of approximately 1.8 mm to 3 mm, inclusive.

* * * * *